United States Patent [19]

Miller

[11] 4,241,475

[45] Dec. 30, 1980

[54] WASTE REMOVER FOR CARDING MACHINE

[75] Inventor: Robert G. Miller, Charlotte, N.C.

[73] Assignee: White Consolidated Industries, Inc., Cleveland, Ohio

[21] Appl. No.: 11,310

[22] Filed: Feb. 12, 1979

[51] Int. Cl.[3] ..... D01G 15/32

[52] U.S. Cl. ..... 19/98; 19/107

[58] Field of Search ..... 19/98, 105, 106 R, 106 A, 19/107, 108

[56] References Cited

U.S. PATENT DOCUMENTS

| | | | |
|---|---|---|---|
| 205,805 | 7/1878 | Moog | 19/98 |
| 334,872 | 1/1886 | Keene | 19/98 |
| 2,774,994 | 12/1956 | Hayes | 19/98 |
| 3,614,813 | 10/1971 | Sloan | 19/107 |
| 3,858,276 | 1/1975 | Hollingsworth | 19/98 |

FOREIGN PATENT DOCUMENTS

| | | | |
|---|---|---|---|
| 1105774 | 4/1961 | Fed. Rep. of Germany | 19/98 |
| 1372455 | 4/1964 | France . | |

*Primary Examiner*—Louis Rimrodt

*Attorney, Agent, or Firm*—Pearne, Gordon, Sessions, McCoy & Granger

[57] ABSTRACT

A carding machine waste remover includes a continuously evacuated chamber containing an adjustably movable array of parallel bars immediately adjacent the surface of revolution of a rotating card cylinder. The bars are each parallel to and equidistantly spaced from the card cylinder axis of rotation. Each bar is of triangular cross section and extends along the length of the card cylinder. One edge of each triangular bar is positioned as a knife edge for stripping small particles of cotton leaf and stem or the like from the outer surface of the cotton fiber web wrapped around the card cylinder. The waste remover is located immediately above the interface area of the card cylinder and its associated doffer cylinder. The array of parallel bars is adjustably mounted between a pair of trunnions each located at respective distal ends of a pair of parallel arms having their other ends pivotally mounted to the carding machine frame. The cleaning of retained waste particles from the array is facilitated by swinging the array away from its engagement with the card cylinder to an operator-accessible cleaning position.

3 Claims, 5 Drawing Figures

WASTE REMOVER FOR CARDING MACHINE

BACKGROUND OF THE INVENTION

The present invention relates in general to fibrous material carding machines and more particularly to a waste remover mechanism for a cotton card.

During cotton carding, it is highly desirable to remove waste material such as cotton stem and leaf from raw cotton fibers as they are being carded. It is especially desirable to provide means for removing waste material that can accumulate between the card cylinder and its housing in an area immediately above the interface area of the card cylinder and doffer cylinder. Various attempts have been made to provide such waste removing means.

U.S. Pat. No. 3,858,276 to Hollingsworth discloses a vacuum creating plate mechanism for exhausting waste material from the area between the card cylinder and its housing intermediate the flats and the interface area or nip area of the doffer and card cylinders. While the Hollingsworth device may alleviate some waste buildup within the card cylinder housing, it provides only a very limited slot-like exhaust port for the ejection of trash, such limited exhaust port being susceptible to "choking" if an accelerated trash exhaust rate should be experienced. Further, Hollingsworth does not provide for the removal of surface carried trash carried on the cotton fiber web wrapped around the rotating card cylinder.

French Pat. No. 1,372,455 to Ecrepont discloses a fixed grate via which is exhausted waste material from the card cylinder housing, the exhaust grate being located immediately below the flats well above the transfer region or nip region between the card cylinder and doffer cylinder. While Ecrepont may provide a plurality of exhaust apertures which, taken together, may exceed in area the limited exhaust port of Hollingsworth, Ecrepont makes no provision for easy removal of his grate for cleaning, nor does Ecrepont provide any means for adjustably positioning his exhaust grate as a whole relative to the card cylinder. Rather, Ecrepont only provides means for individually adjusting the angular position of each of his grate bars relative to the card cylinder surface of revolution.

SUMMARY OF THE INVENTION

The present invention advantageously provides a mechanism for efficiently removing non-fiber waste material from the surface of a moving web of fibers with minimal disturbance to the fiber web upon which the waste material rests. The mechanism includes an array of parallel bars extending generally perpendicularly to the direction of movement of the web of fibers. Each bar provides a knife edge portion immediately adjacent the moving surface of the web. Each knife edge portion strips away non-fiber waste particles carried on the moving surface of the web. An adjustable supporting means is provided for accurately positioning the array relative to the moving surface of the web.

Preferably, the parallel bars are each of triangular cross section with one of their triangular corners or edges positioned as the knife edge portion for stripping the waste material from the moving fiber web. The preferred supporting means includes a pair of parallel arms having distal ends providing a pair of trunnions between which is mounted the array, the parallel bars being perpendicular to the parallel arms. The other ends of the arms are mounted along a common axis for concurrent pivotal movement. The array is swingable along an arcuate path to and away from the moving web of fibers. When it is positioned farthest from the moving web of fibers, the array is fully accessible for manually removing waste material retained thereon. The array is releasably locked at a rotative position on the trunnions by means of variable length turnbuckle-like links extending between the arms and the array at points radially spaced from the trunnions.

The present invention has particular application as a trash remover mechanism located immediately above the interface area or nip area of the card cylinder and doffer cylinder of a cotton carding machine. Each of the parallel bars is immediately adjacent the surface of revolution of the card cylinder, each of the bars being equidistantly spaced from the card cylinder axis of rotation. When the array is at its engagement position closest to the card cylinder surface of revolution, a vacuum hood encloses the array. The hood is evacuated so as to transfer waste material stripped from the fiber web carried on the card cylinder from the array area to a remote waste station. With the hood removed, the array can be swung along an arcuate path lying in a plane normal to the axes of rotation of the card and doffer cylinder to a cleaning position above the doffer cylinder.

The present invention advantageously provides highly efficient waste removal, resulting in exceptionally clean carded cotton fibers.

DESCRIPTION OF THE PREFERRED EMBODIMENT

Figure 1:
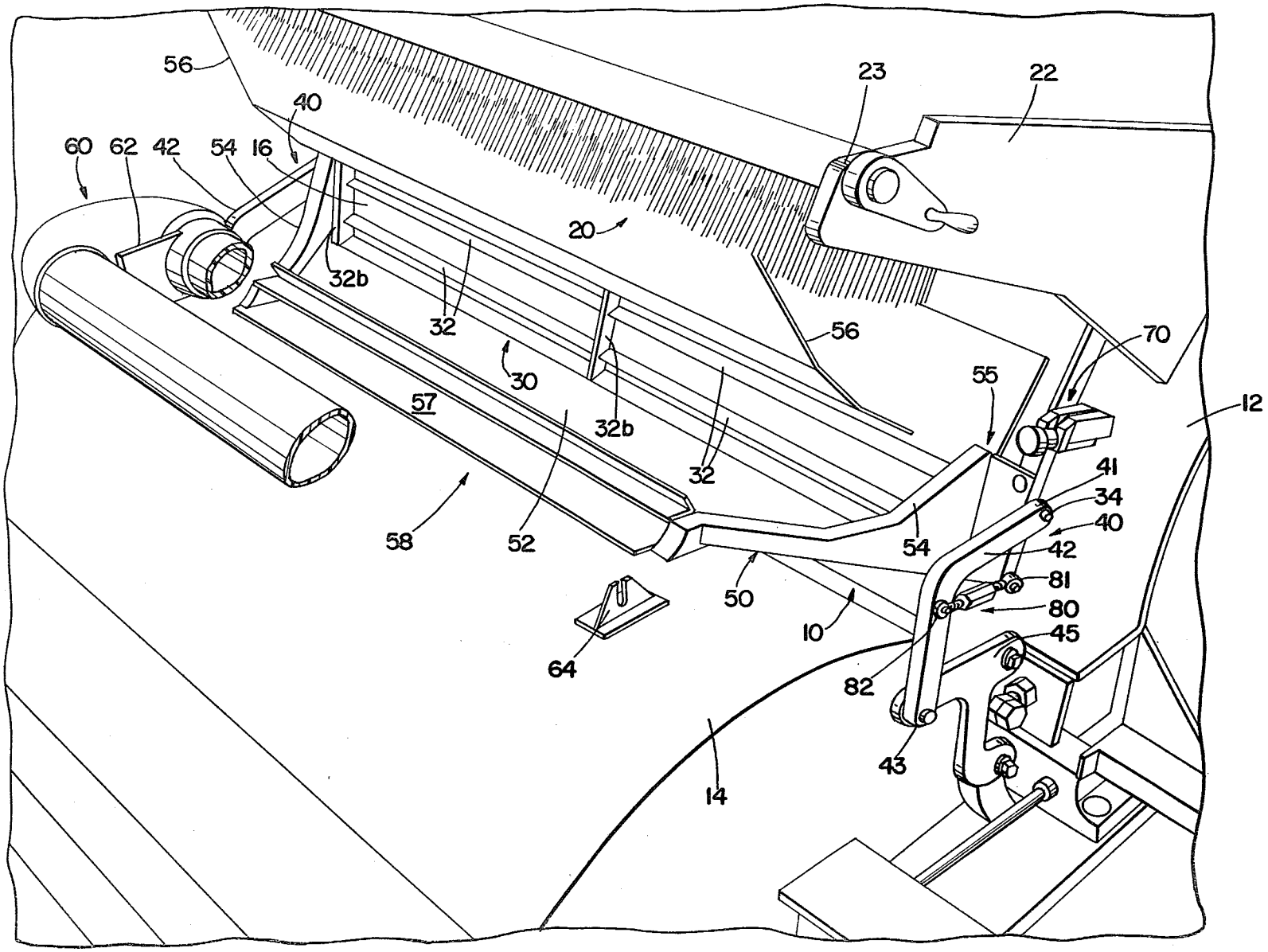
FIG. 1 is a perspective view of a waste remover mechanism in accordance with the invention located immediately above the interface area of the card cylinder and doffer cylinder of a typical cotton carding machine.

Referring to the drawings in greater detail, and in particular to FIG. 1, there is illustrated in perspective view a portion of a typical cotton card machine that includes a waste remover mechanism 10 in accordance with the present invention. The card machine includes a card cylinder housing 12 which generally encloses a card cylinder 13 (FIG. 2), and a doffer cylinder housing 14 which generally encloses a doffer cylinder 14 (FIG. 2) associated with the card cylinder 13. The carding machine includes a longitudinal card flats cleaning brush 20 rotatably mounted between two cleaning brush support brackets 22 (only one shown) which extend from the card cylinder housing 12 radially outwardly from the card cylinder 13 to provide distal ends 23 (only one shown) between which the cleaning brush 20 is mounted. The card flats cleaning brush 20 is conventional in nature and functions to remove entrained cotton fibers from a series of conventional card flats (not illustrated).

Figure 2:
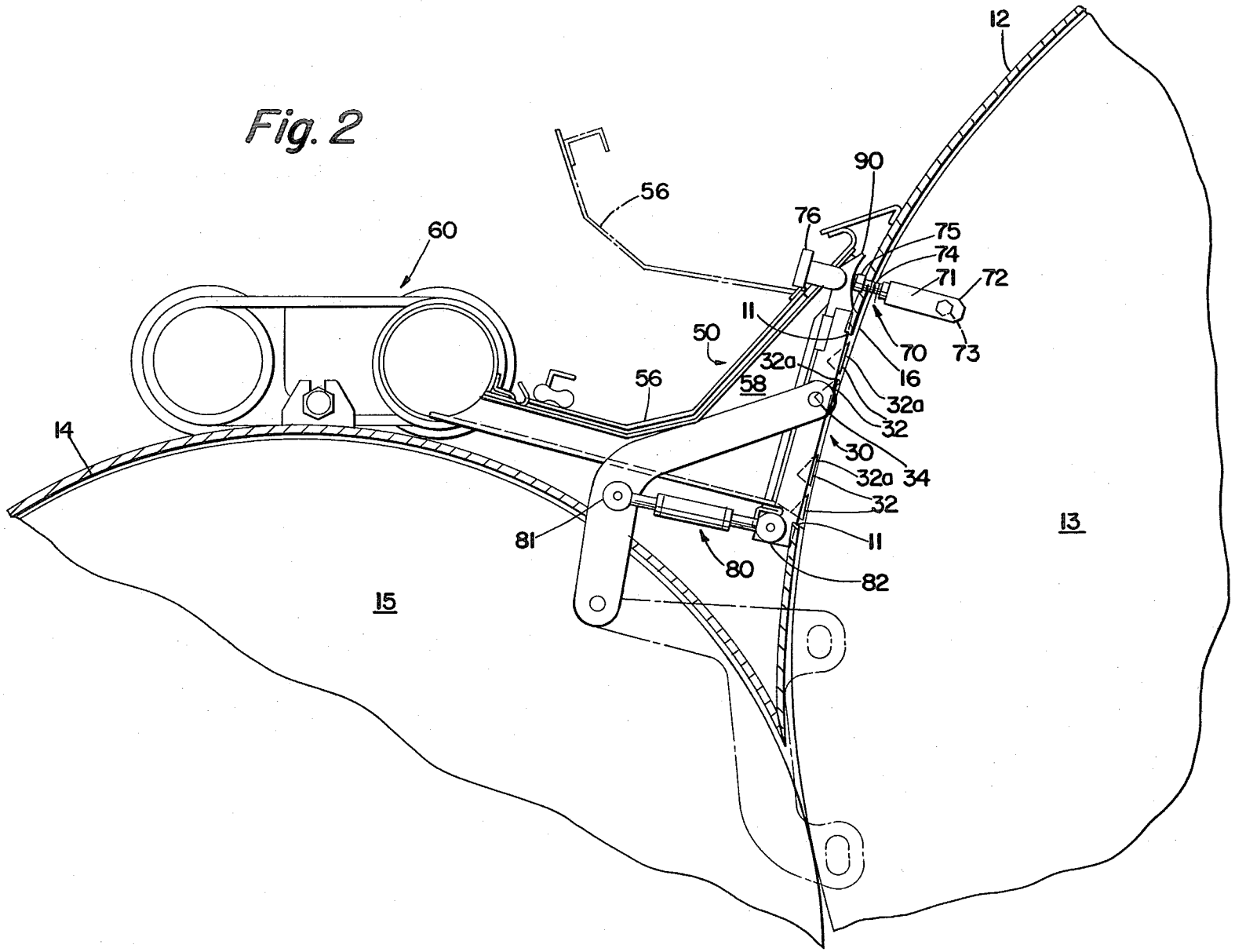
FIG. 2 is a schematic, cross section side view of the mechanism illustrated in FIG. 1.

In accordance with the invention, the waste remover mechanism 10 includes an array 30 of parallel bars 32 fixed relative to each other and extending along the entire length of the card cylinder 13 (FIG. 2). The array 30 is located immediately adjacent to the surface of revolution 16 of the card cylinder 13. The array 30 is adjustably supported as a whole at both of its longitudinal ends by a pair of brackets 40 (only one fully shown).

The array 30 of parallel bars 32 immediately adjacent the card cylinder surface of revolution 16 is enclosed within a waste material exhaust hood 50. The exhaust hood 50 includes a generally continuous floor 52, two vertically extending side walls 54, and a hinged cover 56, shown in FIG. 1 in its upward or open position. Forward edges 55 of the floor 52, side walls 54, and cover 56, are sealingly engaged relative to the card cylinder housing 12 to generally define a rectangular area which includes the array 30. The interior volume within the hood 50 communicates via an appropriate rectangular aperture, defined by card housing aperture walls 11 (FIG. 2), with the interior of the card cylinder housing 12.

With the hinged cover 56 in its lower or closed position (FIG. 2), exterior communication with the interior of the card cylinder housing 12 is established via a rectangular exhaust aperture 57 (FIG. 1) located at the distal end 58 of the exhaust hood 50. This exhaust aperture 57 is connected to an exhaust duct 60 (portions cut away) that is evacuated by appropriate vacuum creating means, wherein waste material is removed from the interior of the card cylinder housing 12 via an exhaust hood chamber 58 (FIG. 2) to an appropriate remote waste station. The exhaust duct 60 is supported on a pair of exhaust duct brackets having upper portions 62 (one shown) fixed to the duct 60 and lower portions 64 (one shown) fixed to the doffer cylinder housing 14. Conventional lockdown means (not shown), when loosened, permit lifting of the duct 60 off the doffer cylinder housing 14 and out of engagement with the hood exhaust aperture 57. The exhaust hood 50 is held in place against the card cylinder housing 12 by appropriate releasable fastening means so as to permit ready removal of the exhaust hood 50 for purposes to be subsequently explained.

In accordance with the invention, the array 30 is rotatably supported at each of its longitudinal ends on a pair of trunnions 34 (only one shown) which lie along a common axis parallel to the axes of rotation of the doffer and card cylinders. The trunnions 34 are each provided at respective first ends 41 of a pair of longitudinal elbow-shaped bracket arms 42 having their other ends 43 pivotally connected to a T-shaped bracket 45 which is fixed relative to the card cylinder housing 12 by appropriate fastening means such as bolts.

Accurate adjustment of the rotatably mounted array 30, rockable on the trunnions 34, is advantageously provided by radial distance adjustment mechanisms 70 (only one shown) for adjusting the distance between the array and the card cylinder axis of rotation and lever arm adjustment mechanisms 80 (only one shown) for canting the array 30 to a generally tangential position relative to the surface of revolution 16 of the card cylinder 15.

Each lever arm adjustment mechanism 80 includes a turnbuckle link that provides a varying length arm having one end 81 pivotally fixed to a respective lower portion of the array 30 and the other end 82 pivotally fixed to its respective bracket arm 42 between the trunnion locations and the bracket pivot point located at the other end 43 of each bracket 42, the ends 81, 82 being spaced radially from the trunnions 34.

Turning to FIG. 2, there is shown in elevation, and with portions removed, a schematic representation of the waste remover mechanism of the present invention. It can be seen that the array 30 includes generally parallel, triangular, cross section bars 32 fixed relative to each other, the bars 32 each having one of their triangular sides 32*a* immediately adjacent to the surface of revolution 16 of the card cylinder 13. The bars 32 are supported in fixed relation to each other by transverse bar supports 32*b* (FIG. 1) located at the array ends and intermediate such ends to provide the array 30, each of the bars 32 being spaced an approximately equal distance from the axis of rotation of the card cylinder 13.

The radial distance adjustment mechanisms 70 each include a straight arm portion 71 having one of its ends 72 pivotally mounted to the card cylinder housing 12 via an appropriate bolt 73. The other end of each arm 71 provides a threaded shaft 74 along which is fixed an adjustment member 75, the shaft 74 being threaded into an appropriate bore in the straight arm portion 71. A locking knob 76 is located at the distal end of the threaded shaft 74. The locking knob 76 is movable along the axis of the threaded shaft 74 and is spring-biased toward the abutment member 75.

Upwardly extending flanges 90 (only one shown) of the array 30 are sandwiched between the abutment members 75 and the spring-biased locking knobs 76. Rotation of the threaded shafts 74 increases or decreases the distance between the pivot point provided by the bolt 73 and the upwardly projecting flange 90 of the array 30, since the abutment members 75 move with rotation of the shafts 74. It can be seen that such adjustment varies the radial distance of the array 30 as a whole from the card cylinder axis of rotation.

Adjustment of each lever arm mechanism 80 varies the distance between the two pivotally connected ends 81,82 of each turnbuckle, such adjustment causing the array 30 to rotate or rock on the trunnions. Such a mechanism permits accurate adjustment of the cant or angular position of the array 30 relative to the surface of revolution 16 of the card cylinder 13.

The waste chamber 58 defined by the exhaust hood 50 is evacuated by an exhaust duct 60 in a manner to be more fully described. Waste material stripped from the cotton fiber web wrapped around the card cylinder 13 by the array 30 of parallel waste remover bars 32 is drawn from the array area through the waste chamber 58 into the exhaust duct 50 for subsequent transfer to a waste station. The waste chamber 58 also collects waste material thrown by centrifugal force from or suctioned from the rotating card cylinder surface of revolution 16.

Figure 3:
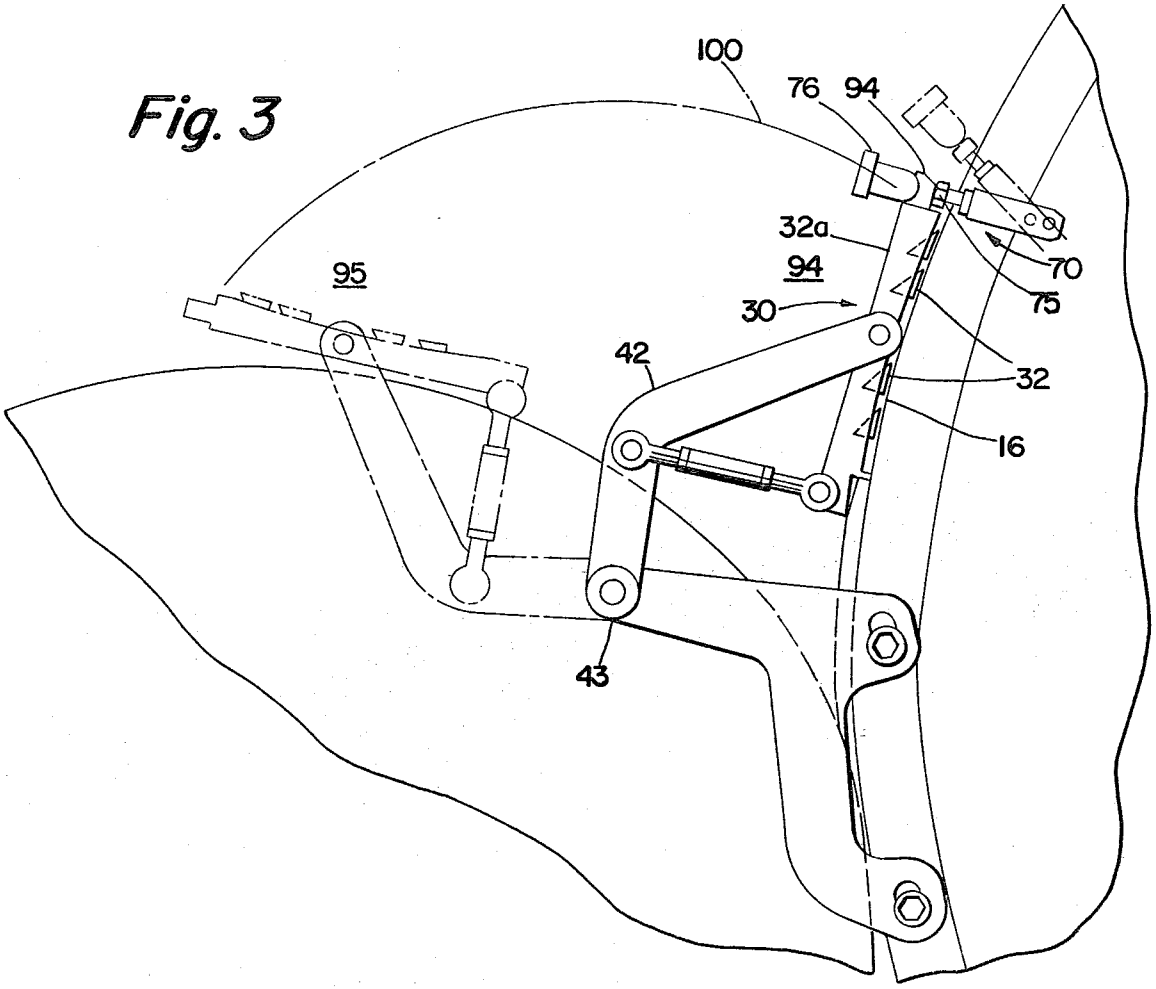
FIG. 3 is a schematic, cross section side view of the mechanism with its operator-accessible cleaning position shown in phantom.

FIG. 3 illustrates movement of the array 30 between an engagement position 94 and an operator-accessible cleaning position 95. With the array 30 in the engagement position 94, the exhaust hood 50 (See FIG. 2) generally encloses and seals the array 30 to preclude access thereto while the card machine is operating. To clean built up, retained waste material from the array bars 32, the vacuum hood 50 and waste duct 60 are removed, as shown in FIG. 3. The spring-biased locking knobs 76 of each radial adjustment mechanism 70 are pulled back away from the array flanges 90 and the adjustment mechanism 70 is swung up out, for example, as an upwardly extending, open ended U-shaped slot (not shown) provided by each of the array flanges 90 of the array. The array 30 is now free to be swung back away from the card cylinder surface of revolution 16. The array 30 travels along an arcuate path 100 lying in a plane normal to the card cylinder axis of rotation to its operator-accessible cleaning position 95 as the bracket arms 42 rotate with the array about the pivot point provided at the bracket ends 43. At the cleaning position 95, all waste material can readily be removed, since all areas of the array 30 are exposed.

After cleaning, the array 30 is swung back towards the card cylinder 13 to its engagement position 94. The radial distance adjustment mechanisms 70 are reengaged with the upper flanges 90 of the array 30, and the locking knobs 76 are released. It can be seen that the array 30 is returned to a precise positioning point relative to the surface of revolution of the card cylinder, since the abutment members 75 of the radial distance adjustment mechanisms 70 and the length of the lever arm adjustment mechanism 80 are not disturbed during the cleaning operation.

The hood 50 and exhaust duct 60 are replaced and releasably locked in position. The carding machine is now ready for operation.

Figure 4:
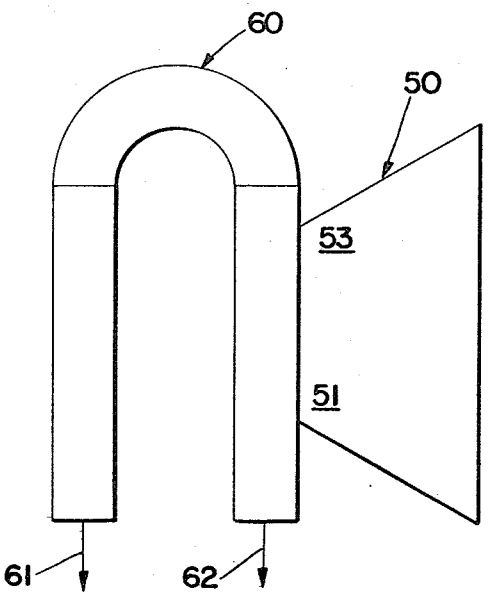
FIG. 4 is a schematic plan view of the vacuum hood for removing waste extracted by the waste remover mechanism.

Turning to FIG. 4, the exhaust duct 60 and exhaust hood 50 are shown schematically in plan view. The duct 60 includes two evacuation paths 61,62. The exhaust hood is evacuated from both ends 51,53 to preclude a build up of waste material. Such an exhaust means has proven to be highly reliable and efficient.

Figure 5:
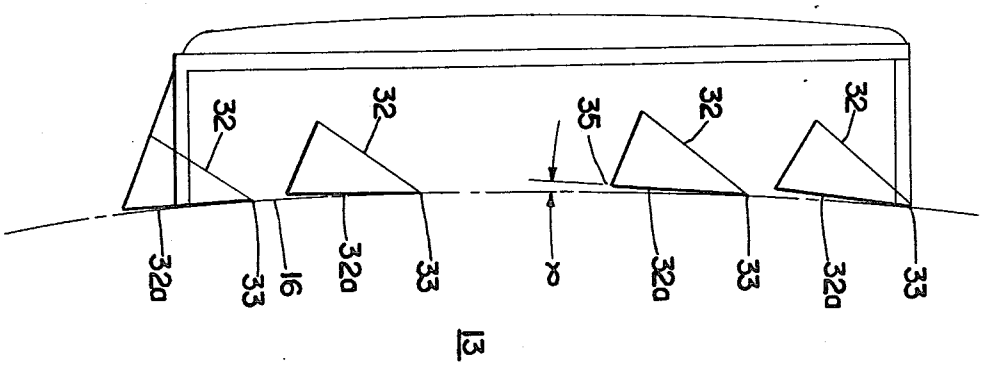
FIG. 5 is a detailed cross section side view of the parallel bar array utilized in the trash remover mechanism, the illustrated bars being triangular in cross section and precisely positioned relative to the surface of revolution of the card cylinder.

Turning to FIG. 5, there is shown in detail the preferred positioning, in accordance with the invention, of the triangular cross section parallel array bars 32. In a preferred form of the invention, four parallel bars 32 are provided and arranged as upper and lower pairs spaced from each other by a distance greater than the distance between the two bars of each respective pair. Each bar 32 provides a knife edge portion or edge 33 immediately adjacent the surface of revolution 16 of the card cylinder 13. Each edge 33 functions to strip cotton stem and leaf or the like type of waste material from the card cylinder surface while stabilizing the surface of the web of cotton fibers wrapped about the card cylinder. The triangular side **32*a* of each bar 32 closest to the axis of rotation of the card cylinder 13 is offset at a slight angle so as to lie along a non-tangential line 35 relative to the card cylinder surface of revolution 16 to provide the noted knife edges 33**.

The present invention provides a relatively simple trash remover mechanism that is easily maintained and highly reliable.

Although the preferred embodiment of this invention has been shown and described, it should be understood that various modifications and rearrangements of parts may be resorted to without departing from the scope of the invention as disclosed and claimed herein.

What is claimed is:

1. In a cotton carding machine having a housing generally enclosing a rotatably mounted card cylinder and a rotatably mounted doffer cylinder, the cylinders having axes of rotation parallel to each other and having opposed surfaces of revolution, the cylinders being juxtaposed to define an interface area, a waste remover mechanism comprising:

an adjustably movable array of triangular cross section parallel bars immediately adjacent the surface of revolution of the rotating card cylinder, the bars each being parallel to and equidistantly spaced from the card cylinder axis of rotation, each bar extending along generally the entire length of the card cylinder, a longitudinal edge of each triangular cross section bar being positioned to strip non-cotton fiber waste material from the outer surface of the cotton fiber web wrapped around the card cylinder;

bracket means for supporting and positioning the array relative to the card cylinder, the bracket means including a first end pivotally mounted to the carding machine and a second end providing a pair of trunnions lying along a common axis of rotation parallel to the card cylinder axis of rotation, the array being rotatably mounted to and between the trunnions, the trunnions revolvable in an arcuate path about the pivot point of the pivotally mounted first end, the array being movable along the arcuate path between an engagement position with the card cylinder and an operator-accessible cleaning position spaced away from the card cylinder; and vacuum hood means enclosing the array when in its engagement position, the vacuum hood means communicating with the interior of the main housing, the vacuum hood means operable to convey the stripped non-cotton fiber waste material from the array area to a waste station when the array is at its engagement position.

2. A waste remover mechanism according to claim 1, including a radial distance adjustment mechanism for adjusting the distance between the array and the card cylinder axis of rotation.

3. A waste remover according to claim 1, including a lever arm adjustment mechanism for canting the array to a generally tangential position relative to the surface of revolution of the card cylinder.

* * * * *